US006504505B1

(12) United States Patent
Yung

(10) Patent No.: US 6,504,505 B1
(45) Date of Patent: Jan. 7, 2003

(54) PHASE CONTROL NETWORK FOR ACTIVE PHASED ARRAY ANTENNAS

(75) Inventor: Kar W. Yung, Torrance, CA (US)

(73) Assignee: Hughes Electronics Corporation, El Segundo, CA (US)

( * ) Notice: Subject to any disclaimer, the term of this patent is extended or adjusted under 35 U.S.C. 154(b) by 0 days.

(21) Appl. No.: 09/702,264

(22) Filed: Oct. 30, 2000

(51) Int. Cl.[7] ..... H01Q 3/26
(52) U.S. Cl. ..... 342/374
(58) Field of Search ..... 342/372, 374

(56) References Cited

U.S. PATENT DOCUMENTS

| | | | | |
|---|---|---|---|---|
| 4,635,063 A | | 1/1987 | Chang et al. | |
| 4,779,242 A | * | 10/1988 | Lannuzel | 367/105 |
| 5,077,562 A | | 12/1991 | Chang et al. | |
| 5,594,941 A | | 1/1997 | Dent | |
| 5,856,804 A | | 1/1999 | Turcotte et al. | |
| 5,903,549 A | | 5/1999 | Von der Embse et al. | |
| 5,909,460 A | | 6/1999 | Dent | |
| 6,121,931 A | | 9/2000 | Levi | 343/700 |
| 6,147,658 A | | 11/2000 | Higashi et al. | |
| 6,151,496 A | | 11/2000 | Richards et al. | |
| 6,160,510 A | * | 12/2000 | Busking et al. | 342/374 |
| 6,184,828 B1 | * | 2/2001 | Shoki | 342/372 |

FOREIGN PATENT DOCUMENTS

WO WO 98/05089 2/1998

OTHER PUBLICATIONS

Sato, K. et al, "Development and Field Experiments of Phased Array Antenna for Land Vehicle Satellite Communications", *Antennas and Propagation Society International Symposium*, 1992 AP–S. 1992 Digest, pp. 1073–1076.

Miura, R. et al., "A DBF Self–Beam Steering Array Antenna for Mobile Satellite Applications Using Beam–Space Maximal–Ratio Combination", *IEEE Transactions on Vehicular Technology*, vol. 48, No. 3, May 1999, pp.665–675.

Chiba, I. et al., "Digital Beam Forming (DBF antenna System for Mobile Communications", *IEEE AES Systems Magazine*, Sep. 1997, pp. 31–41.

Suzuki R., et al, "Mobile TDM/TDMA System with Active Array Antenna", Global Telecommunications conf. 1991, Dec. 1991, pp. 1569–1573.

J. R. Potukuchi et al., "MMIC Modules for Active Phased–Array Applications In Communications Satellites", MSN & CT, Nov. 1988, pp. 20–27.

* cited by examiner

*Primary Examiner*—Thomas H. Tarcza
*Assistant Examiner*—Fred H. Mull
(74) *Attorney, Agent, or Firm*—V. D. Duraiswamy; M. W. Sales

(57) ABSTRACT

A phase control block for combining signals from a phased array antenna includes a phase shifter for generating a phase shifted signal; a phase switch connected to the phase shifter having a first state wherein the phase switch connects a first signal to a switched signal output and a second signal to the phase shifter; and a signal summing device connected to the phase shifter for generating an output that is a sum of the switched signal output and the phase shifted signal.

22 Claims, 5 Drawing Sheets

PHASE CONTROL NETWORK FOR ACTIVE PHASED ARRAY ANTENNAS

BACKGROUND OF THE INVENTION

The present invention relates generally to active phased array antenna arrays for generating communications signals. More specifically, but without limitation thereto, the present invention relates to shifting the phase of an input signal at each array element of an antenna to form a beam.

A phased array antenna is typically used for transmitting and receiving microwave signals in a specific beam direction or multiple directions at the same time. The array elements of the phased array antenna consist of a large number of radiators. In the receiving mode, the signal from each array element is phase shifted or time shifted (for large bandwidth signals) by a chain of phase shifters before summing to generate a beam output signal. The networks of phase shifter chains currently used for phased array antennas are typically large and have a correspondingly high cost.

SUMMARY OF THE INVENTION

The present invention advantageously addresses the problems above as well as other problems by providing a phase control network for combining signals from a phased array antenna having a substantially reduced number of components.

In one embodiment, the present invention may be characterized as a phase control block for combining signals from a phased array antenna that includes a phase shifter for generating a phase shifted signal; a phase switch connected to the phase shifter having a first state wherein the phase switch connects a first signal to a switched signal output and a second signal to the phase shifter; and a signal summing device connected to the phase shifter for generating an output that is a sum of the switched signal output and the phase shifted signal.

In another embodiment, the present invention may be characterized as a phase control network for combining signals from a phased array antenna that includes a plurality of phase control blocks having a pair of inputs and a single output connected in a tree pattern to generate a single beam output signal.

In yet another embodiment, the present invention may be characterized as a method for combining signals from a phased array antenna that includes the steps of (a) receiving a plurality of input signals in pairs wherein each of the pairs comprises a first input signal and a second input signal; (b) phase shifting one of the first input signal and the second input signal to generate a phase-shifted signal; and (c) summing the phase shifted signal with another of the first input signal and the second input signal to generate a sum signal for each of the pairs.

BRIEF DESCRIPTION OF THE DRAWINGS

The above and other aspects, features and advantages of the present invention will be more apparent from the following more specific description thereof, presented in conjunction with the following drawings wherein.

Corresponding reference characters indicate corresponding elements throughout the several views of the drawings.

DETAILED DESCRIPTION OF THE DRAWINGS

The following description is presented to disclose the currently known best mode for making and using the present invention. The scope of the invention is defined by the claims.

Figure 1:
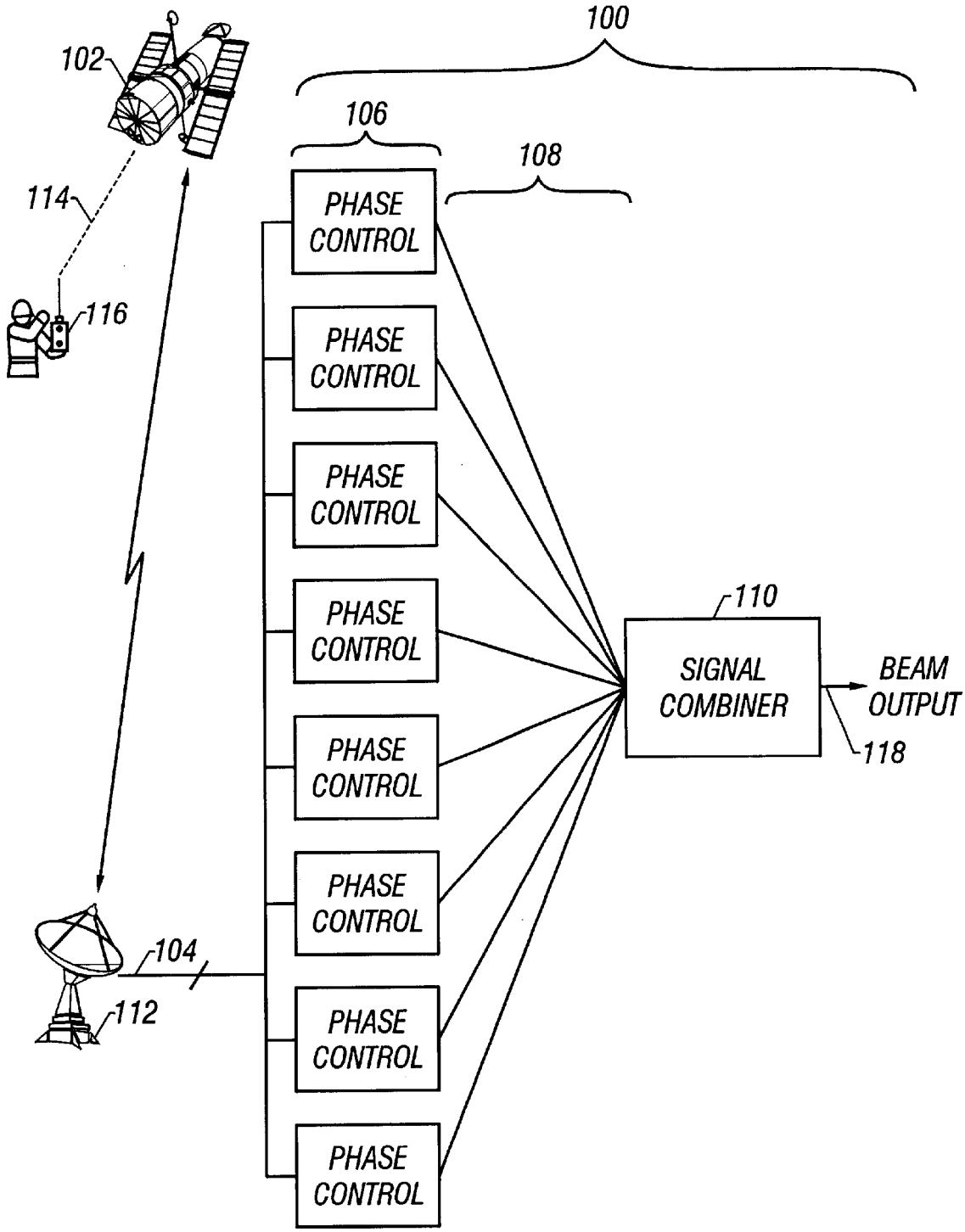
FIG. 1 (PRIOR ART)
FIG. 1 is a diagram of a phase control network of the prior art for combining signals from a phased array antenna.

FIG. 1 is a diagram of a phase control network 100 of the prior art for combining signals from a phased array antenna. Shown in FIG. 1 are a phased array antenna 102, input signals 104, phase control blocks 106, phase shifted signals 108, a signal combiner 110, a ground link 112, a beam direction 114, a transmitter 116, and a beam output signal 118. The phased array antenna 102 may be, for example, a patch antenna array made according to well known techniques and mounted on a transponder platform for mobile communications linked to a hub such as the ground link 112. The phased array antenna 102 typically includes signal amplifiers (not shown) for receiving and transmitting signals.

To receive a signal in the beam direction 114 from the transmitter 116, the amplified input signal 104 from each array element is shifted by one of the phase control blocks 106 so that each of the phase shifted signals has the same phase in the direction of the desired beam. The amount of the phase shift for each of the input signals 104 is a function of the beam direction and the geometry of the phased array antenna 102. The phase shifted signals 108 all have the appropriate phase and are summed by the signal combiner 110 to generate the beam output signal 118 that has a peak gain in the desired beam direction. Signals received from the phased array antenna 102 that are not from the selected beam direction do not have the same relative phase after phase shifting and therefore have a lower gain compared to the signals received and summed in phase from the beam direction.

The amount of the phase shift required from each of the phase control blocks 106 between adjacent array elements may be expressed by the formula $$\Delta\Phi = \frac{2\pi}{\lambda} d \sin\theta \tag{1}$$

where $\Delta\Phi$ is the phase difference between an adjacent pair of array elements, $\lambda$ is the wavelength of the received signal, d is the spacing between array elements, and $\theta$ is the beam direction.

Because each of the input signals 104 connected to the phase control blocks 106 may be from any element of the phased array antenna 102, each of the phase control blocks 106 requires the capability of shifting the full $2\pi$ range of phase angles. Assuming a quantization of the $2\pi$ range of phase angles into m bits, i.e., m phase shifters 204 for each of phase control blocks 106, a typical phase control block for m=2 is shown in FIG. 2.

Figure 2:
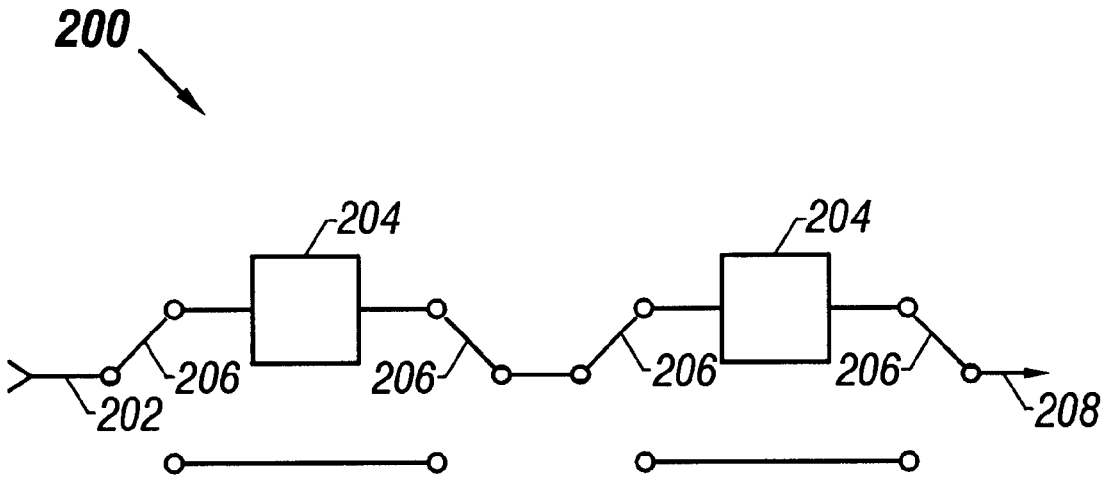
FIG. 2 (PRIOR ART)
FIG. 2 is a schematic diagram of one of the phase control blocks of FIG. 1.

FIG. 2 is a schematic diagram 200 of one of the phase control blocks 106 of FIG. 1. Shown in FIG. 2 are an input 202, phase shifters 204, phase control switches 206, and an output 208. The phase shifters 204 typically have a phase shift of 180 degrees/$2^{n-1}$, where n is the sequence number of the phase shifter 204. For example, for the two-stage phase control block 106, the first phase shifter 204 has a phase shift of 180/1=180 degrees, and the second phase shifter has a phase shift of 180 degrees/2=90 degrees. A third phase shifter would have a phase shift of 180/4=45 degrees, and so on. The input 202 is connected in series by the phase control switches 206 to a selected number of the phase shifters 204 and to the output 208. For example, if all four of the phase control switches 206 are switched off, the signal at the output 208 would have a phase shift of zero. If the first two of the phase control switches 206 were switched on, the signal at the output 208 would have a phase shift of 180 degrees. If all four of the phase control switches 206 are switched on, the signal at the output 208 would have a phase shift of 270 degrees.

For a number of array elements n and a phase shift angle quantization of m bits, the number of phase control blocks 106 required for the phase control network of FIG. 1 is equal to n×m. The number of single-pole, single-throw switches (two for each of phase control switches 206) is equal to 4×n×m. Table 1 illustrates the complexity of the phase control network 100 of FIG. 1 for several values of n and m.

TABLE 1

| n | m | shifters | switches |
|---|---|---|---|
| 8 | 3 | 24 | 96 |
| 32 | 4 | 128 | 512 |
| 512 | 3 | 1536 | 6144 |

Phase control blocks 106 are typically implemented in monolithic microwave integrated circuits (MMICs). In general, the cost of MMICs increases as the complexity, therefore a reduction in the complexity reduces the cost of the phase control network 100.

Figure 3:
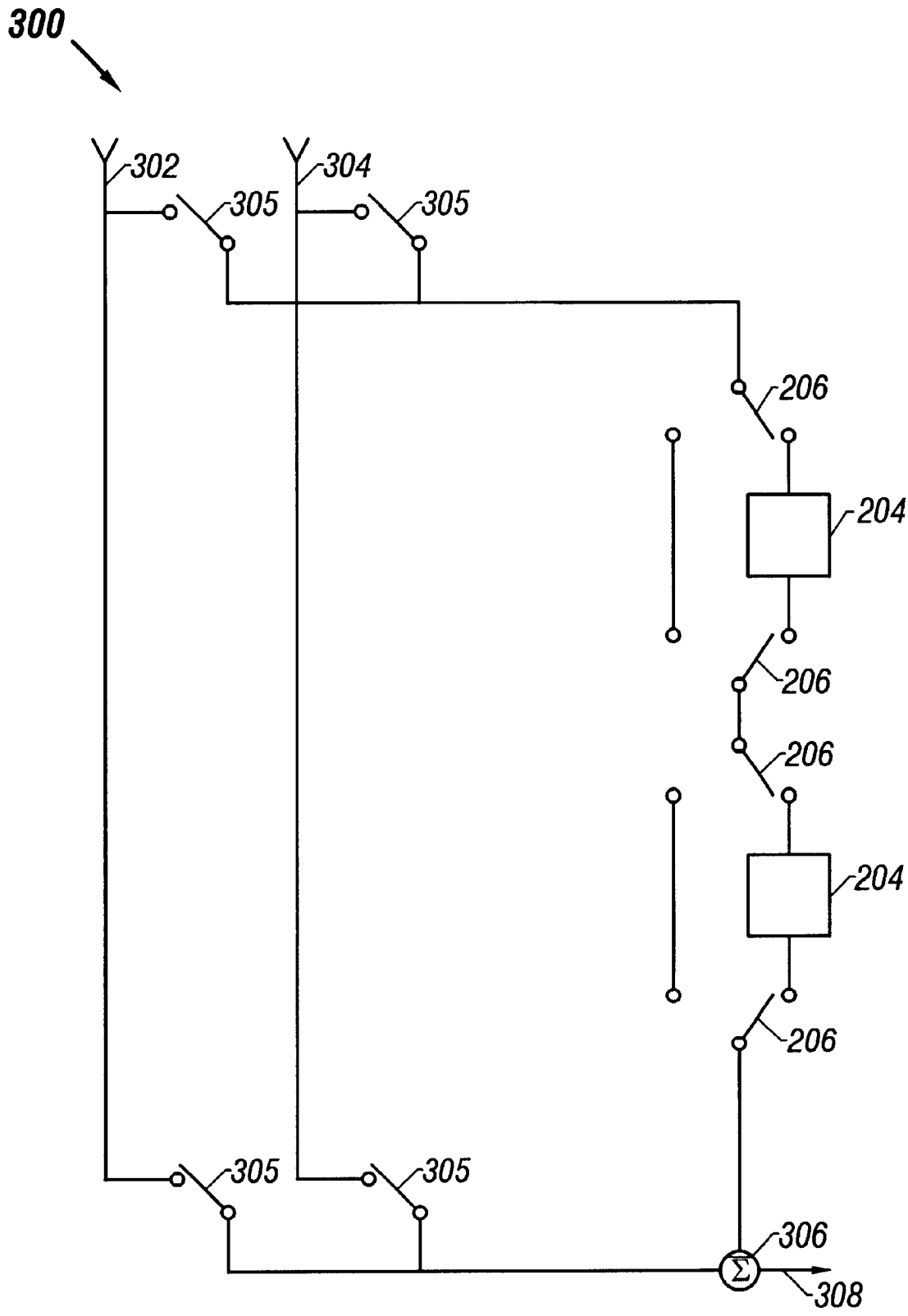
FIG. 3 is a block diagram of a phase control block for combining signals from the phased array antenna of FIG. 1 according to an embodiment of the present invention.

FIG. 3 is a block diagram of a phase control block 300 for combining signals from a phased array antenna. Shown in FIG. 3 an first input signal 302, a second input signal 304, phase reversing switches 305, phase shifters 204, phase control switches 206, a signal summer 306, and an output 308.

The phase reversing switches 305 are arranged to connect a pair of input signals from the phased antenna array 102 in FIG. 1 so that in a first state, the first input signal 302 is connected to a selected number of the phase shifters 204, and the second input signal 304 is connected to the signal summer 306. In a second state, the second input signal 304 is connected to a selected number of the phase shifters 204, and the first input signal 302 is connected to the signal summer 306. By selecting the first state or the second state of the phase reversing switches 305, a full 360 degrees of relative phase shift may be achieved by a relative phase shift of ±180 degrees. In this arrangement, only m−1 phase shifters 204 are required compared to m phase shifters 204 for the phase control block 200 of FIG. 2. Alternatively, the bit saved by dividing the 360 degree phase shift by two may be used for higher phase resolution. Accordingly, the output 308 of the signal summer 306 is the sum of the first input signal 302 and the second input signal 304 with a relative phase shift selected according to formula (1).

Figure 4:
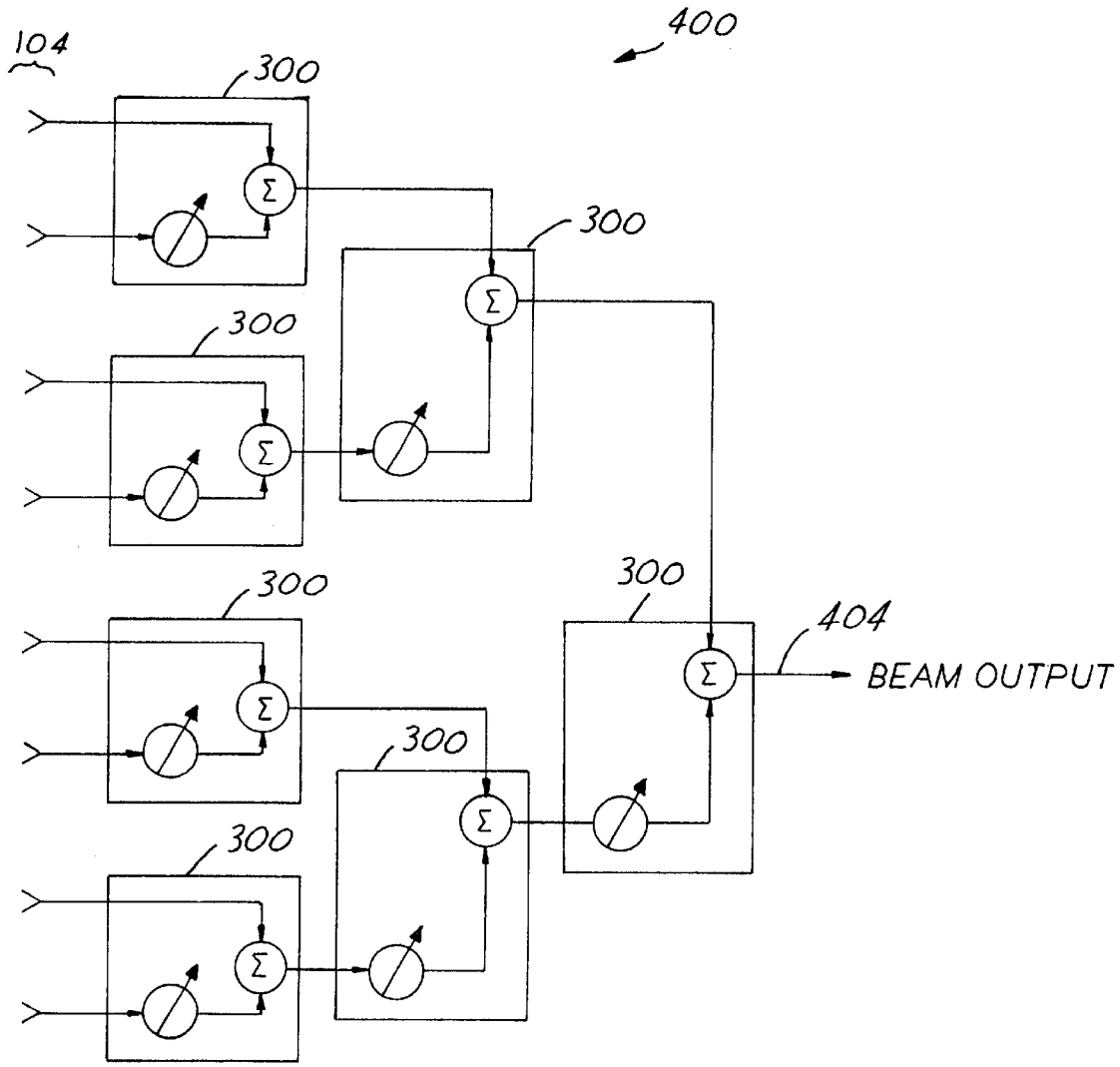
FIG. 4 is a phase control network for combining signals from a phased array antenna using the phase control blocks of FIG. 3.

FIG. 4 is a phase control network 400 for combining signals from the phased array antenna 102 of FIG. 1 using the phase control blocks 300 of FIG. 3. Shown in FIG. 4 are input signals 104 from the phased array antenna 102, phase control blocks 300, and a beam output signal 404.

Each pair of input signals from the phased array antenna 102 is connected as the first input signal 302 and the second input signal 304 of one of the phase control blocks 300. The output of each of the phase control blocks 300 is connected as either the first input signal 302 or the second input signal 304 of another of the phase control blocks 300 in a tree pattern until all of the input signals have been summed together in the single beam output signal 404. The beam output signal 404 has the appropriate relative signal phase for each of the input signals from the phased array antenna 102 for the selected beam direction 114.

The number of phase control blocks is reduced in the arrangement of FIG. 4 to n−1 compared to n for the conventional arrangement of FIG. 1. The number of phase shifters was also reduced to m−1 compared to m in the arrangement of FIG. 1 by reducing the phase range from 360 degrees to 180 degrees as explained above. By pairing input signals from array elements of the phased antenna array 102 that are geometrically close, the range of the required relative phase shift of each of the phase control blocks 300 may be further reduced, reducing the number of phase shifters 204 by, in general, k bits. The number of phase control blocks 300 required for the phase control network of FIG. 4 is accordingly equal to (n−1) (m−1−k), and the number of single-pole, single-throw switches is equal to 4(n−1)(m−k). Table 2 illustrates the relative complexity of the phase control network 400 of FIG. 4 for k=1.

TABLE 2

| n | m | shifters | switches |
|---|---|---|---|
| 8 | 3 | 7 (29.2%) | 56 (58.3%) |
| 32 | 4 | 128 (48.4%) | 372 (72.7%) |
| 512 | 3 | 1536 (33.3%) | 4088 (66.5%) |

The percentages are the ratios relative to the values illustrated in Table 1 for the conventional phase control network 100 of FIG. 1.

Figure 5:
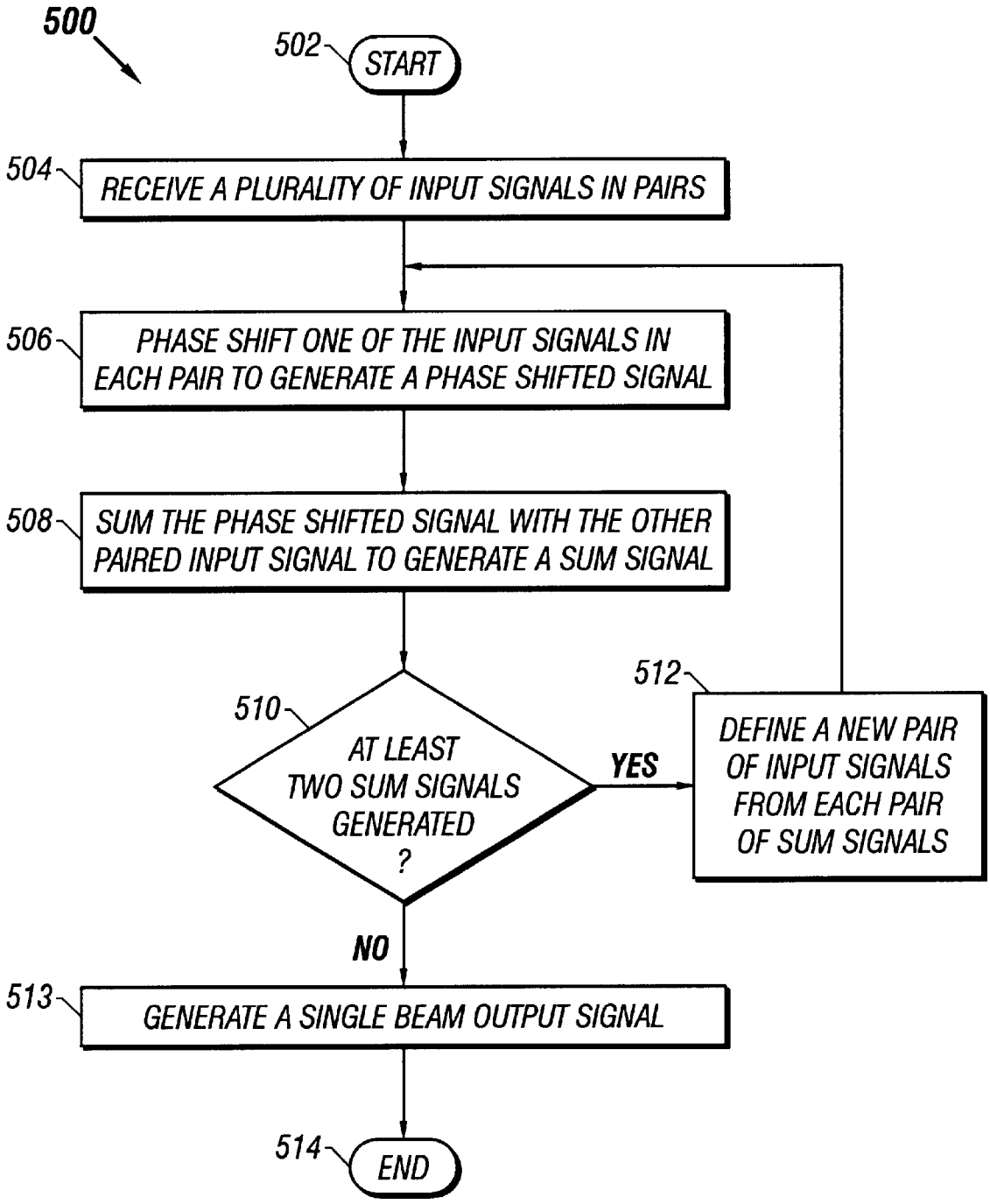
FIG. 5 is a flow chart of a method for combining signals from a phased array antenna according to another embodiment of the present invention.

FIG. 5 is a flow chart 500 of a method for combining signals from a phased array antenna. Step 502 is the entry point of flow chart 500. Step 504 receives a plurality of input signals from the phased array antenna in pairs. Step 506 phase shifts one of the input signals to generate a phase-shifted signal. Step 508 sums the phase-shifted signal with the other paired input signal to generate a sum signal for each of the input signal pairs. Step 510 checks whether at least two sum signals were generated in step 508. If yes, Step 512 defines a new first input signal and a new second input signal from each pair of sum signals while step 508 generates at least two sum signals. Steps 506, 508, and 510 are repeated until step 508 generates a single sum signal. Step 510 then transfers control to step 513, which generates the beam output signal. Step 514 is the exit point of the flow chart 500.

While the invention herein disclosed has been described by means of specific embodiments and applications thereof, other modifications, variations, and arrangements of the present invention may be made in accordance with the above teachings other than as specifically described to practice the invention within the spirit and scope defined by the following claims.

What is claimed is:

1. A phase control block for combining signals from a phased array antenna comprising:

a phase shifter;

a plurality of phase switches connected to the phase shifter having a first state wherein the plurality of phase switches forms a non-phase shifted signal from a first signal and a phase shifted signal from a second signal at the phase shifter and a second state wherein the plurality of phase switches forms a non-phase shifted signal from the second signal and a phase shifted signal from the first signal at the phase shifter; and a signal summing device connected to the phase shifter and the plurality of phase switches for generating a summed output signal that is the sum of the non-phase shifted signal and the phase shifted signal.

2. A phase control network comprising:

a plurality of phase control blocks as recited in claim 1.

3. A phase control network comprising:

a first phase control block as recited in claim 1 having a first output signal;

a second phase control block as recited in claim 1 having a second output signal; and a third phase control block as recited in claim 1 receiving the first output signal and the second output signal and generating a third output signal in response to the first output signal and the second output signal.

4. A phase control block as recited in claim 1 wherein the plurality of phase switches comprises a plurality of single pole, single throw switches.

5. A phase control block as recited in claim 1 wherein said plurality of phase switches comprises a plurality of phase control switches selectively coupling a first input and a second input to said signal summing device.

6. A phase control block as recited in claim 5 wherein said phase shifter comprises a first phase shifter and a second phase shifter, and said plurality of phase control switches selectively coupling said first phase shifter and said second phase shifter to said summing device.

7. A phase control block as recited in claim 1 wherein said plurality of phase switches comprises a plurality of phase reversing switches selectively coupling a first input and a second input to said signal summing device.

a signal summing device connected to the phase shifter and the phase switch for generating a summed output signal that is the sum of the non-phase shifted signal and the phase shifted signal.

8. A phase control network for combining signals from a phased array antenna comprising:

a plurality of phase control blocks having a pair of inputs and a single output connected in a tree pattern to generate a single output signal;

a phase shifter;

a plurality of phase switches connected to the phase shifter having a first state wherein the plurality of phase switches forms a non-phase shifted signal from a first signal and a phase shifted signal from a second signal at the phase shifter and a second state wherein the plurality of phase switches forms a non-phase shifted signal from the second signal and a phase shifted signal from the first signal at the phase shifter; and a signal summing device connected to the phase shifter and the plurality of phase switches for generating an output signal that is the sum of the non-phase shifted signal and the phase shifted signal.

9. A phase control network as recited in claim 8 wherein the plurality of phase switches comprises a plurality of single pole, single throw switches.

10. A phase control network as recited in claim 8 wherein said plurality of phase switch comprises a plurality of phase control switches selectively coupling a first input an a second input to said signal summing device.

11. A phase control network as recited in claim 10 wherein said plurality of phase shift comprises a first phase shifter and a second phase shifter and said plurality of phase control switches selectively coupling said first phase shifter and said second phase shifter to said summing device.

12. A method for combining signals from a phased array antenna comprising the steps of:

(a) receiving a plurality of input signals in pairs wherein each of the pairs comprises a first input signal and a second input signal;

(b) in a first state of a switching circuit, phase shifting the first input signal to generate a phase-shifted signal;

(c) non-phase shifting the second signal to form a non-phase shifted signal;

(d) in a second state of the switching circuit, phase shifting the second input signal to form the phase-shifted signal;

(e) non-phase shifting the first signal to form the non-phase shifted signal; and (f) summing the phase shifted signal with the non-phase shifted signal to generate a sum signal for each of the pairs.

13. A method as recited in claim 12 further comprising the step of providing a switching circuit in a first state.

14. A method as recited in claim 13 wherein the step of providing a switching circuit in a first state comprises switching a plurality of phase reversing switches.

15. A method as recited in claim 14 wherein the step of phase shifting comprises phase shifting the first input signal in response to said plurality of phase reversing switches and a phase shifter.

16. A method as recited in claim 13 wherein the step of providing a switching circuit in a first state comprises switching a plurality of phase control switches.

17. A method as recited in claim 16 wherein the step of phase shifting comprises phase shifting the first input signal in response to said plurality of phase control switches and a phase shifter.

18. A method as recited in claim 12 further comprising the step of providing a switching circuit in a second state.

19. A method as recited in claim 18 wherein the step of providing a switching circuit in a second state comprises switching a plurality of phase reversing switches.

20. A method as recited in claim 19 wherein the step of phase shifting comprises phase shifting the second input signal in response to said plurality of phase reversing switches and a phase shifter.

21. A method as recited in claim 18 wherein the step of providing a switching circuit in a second state comprises switching a plurality of phase control switches.

22. A method as recited in claim 21 wherein the step of phase shifting comprises phase shifting the second input signal in response to said plurality of phase control switches and a phase shifter.

* * * * *